US005458255A

United States Patent [19]

Addeo et al.

[11] Patent Number: 5,458,255

[45] Date of Patent: Oct. 17, 1995

[54] FOLDING CASE FOR FRUIT AND VEGETABLES

[75] Inventors: Antonio Addeo, Novara; Aurelio Biscotti, Cantalupo di Cerro Maggiore; Ivan Paris, Milan, all of Italy

[73] Assignee: Himont Italia S.p.A., Italy

[21] Appl. No.: 268,830

[22] Filed: Jun. 29, 1994

[30] Foreign Application Priority Data

Jul. 1, 1993 [IT] Italy ..... MI93U0543 U

[51] Int. Cl.[6] ..... B65D 6/18

[52] U.S. Cl. ..... 220/6; 220/7

[58] Field of Search ..... 220/6, 7

[56] References Cited

U.S. PATENT DOCUMENTS

| | | | |
|---|---|---|---|
| 1,972,483 | 9/1934 | Hartson | 220/6 |
| 2,350,673 | 6/1944 | Costigan | 220/6 X |
| 2,525,838 | 10/1950 | Smith et al. | 220/6 X |
| 3,796,342 | 3/1974 | Sanders et al. | 220/7 X |
| 4,235,346 | 11/1980 | Liggett | 220/6 X |
| 4,320,845 | 3/1982 | Waller | 220/6 |
| 4,820,383 | 4/1989 | Shchamorov et al. | 220/7 X |
| 5,038,953 | 8/1991 | Radar | 220/6 |
| 5,299,704 | 4/1994 | Thorby et al. | 220/6 |

FOREIGN PATENT DOCUMENTS

| | | |
|---|---|---|
| 60137/90 | 8/1989 | Australia . |
| 023461 | 7/1980 | European Pat. Off. . |
| 301140 | 7/1987 | European Pat. Off. . |
| 1086100 | 9/1977 | Italy . |
| WO-A-90/12738 | 11/1989 | WIPO . |

*Primary Examiner*—Steven M. Pollard
*Attorney, Agent, or Firm*—Bryan Cave; David M. Klein

[57] ABSTRACT

A folding case of polymeric material comprises two equal elements which can be coupled in a rapid way. Each element comprises a side wall of the case articulated, by means of film hinges, to a base panel and to two side panels suitable for defining, respectively, a half portion of the bottom wall and half portions of side folding walls of the case.

5 Claims, 12 Drawing Sheets

FOLDING CASE FOR FRUIT AND VEGETABLES

The present invention relates to a folding case of polymeric material having a bottom wall and four side walls, particularly suitable for being used for transporting fruit and vegetables.

The need for providing folding cases is well known in the sector of packaging and derives from the matter of fact that the transport should be avoided of empty cases in mutual stacked arrangement. An alternative to the folding cases consists in providing disposable cases of low-cost polymeric materials, to be used once only; such a solution is not acceptable nowadays above all from the viewpoint of environmental safeguard, in particular if one considers that only a portion of the material which constitutes such disposable cases is recycled.

As regards the folding cases, already some solutions exist and are disclosed in patent applications EP-A-301 140, WO-A-90/12 738, AU-A-60 137/90 and in Italian Patent IT 1 086 100. Although they accomplish the purpose of providing a folding case, all of these solutions known from the prior art display some disadvantages which limit the use and the usefulness thereof. In particular, in such solutions known from the prior art, the following disadvantages can be observed:

- difficulty of giving the cases such dimensions as required by the market (external overall dimensions/internal capacity, presence of protrusions beyond the external contour, and so forth);
- difficulty of obtaining both expected configurations (i.e., the open/closed configuration);
- difficulty of assembly during the manufacturing step;
- the cases are not predisposed for being lifted by means of mechanical lifting devices;
- high investment costs for the molds, because the cases are constituted by a plurality of parts.

The purpose of the present invention is of overcoming said disadvantages, thanks to the fact that the case comprises two mutually equal elements linked to each other at the centre line of two mutually facing walls which can be folded by means of articulation hinges, with each element comprising a rigid side wall which is articulatedly linked, by means of respective film hinges, to a base panel which defines a portion of the bottom wall of the case and to two side panels which define portions of the folding walls.

Thanks to such characteristics, one single mould having reduced size, for half case, is enough, with the investment costs for the molding equipment being thus considerably reduced. Furthermore, the presence of six film hinges in each case considerably simplifies the first case assembly, because it results that only both articulation hinges at the folding side walls have to be mechanically hooked. Further advantages of the case according to the present invention derive from the semplicity of opening/closing, absence of internal and external protrusions (optimal exploitation of available room during the transport, in both of case open/closed configurations), the flexibility of wall dimensioning and the reduced overall dimensions of the closed case (of the order of one sixth relatively to the open configuration).

Further advantages and characteristics will be evident from the following disclosure in detail, supplied for merely non-limitative exemplifying purposes, by referring to the attached drawings, in which.

Figure 1:
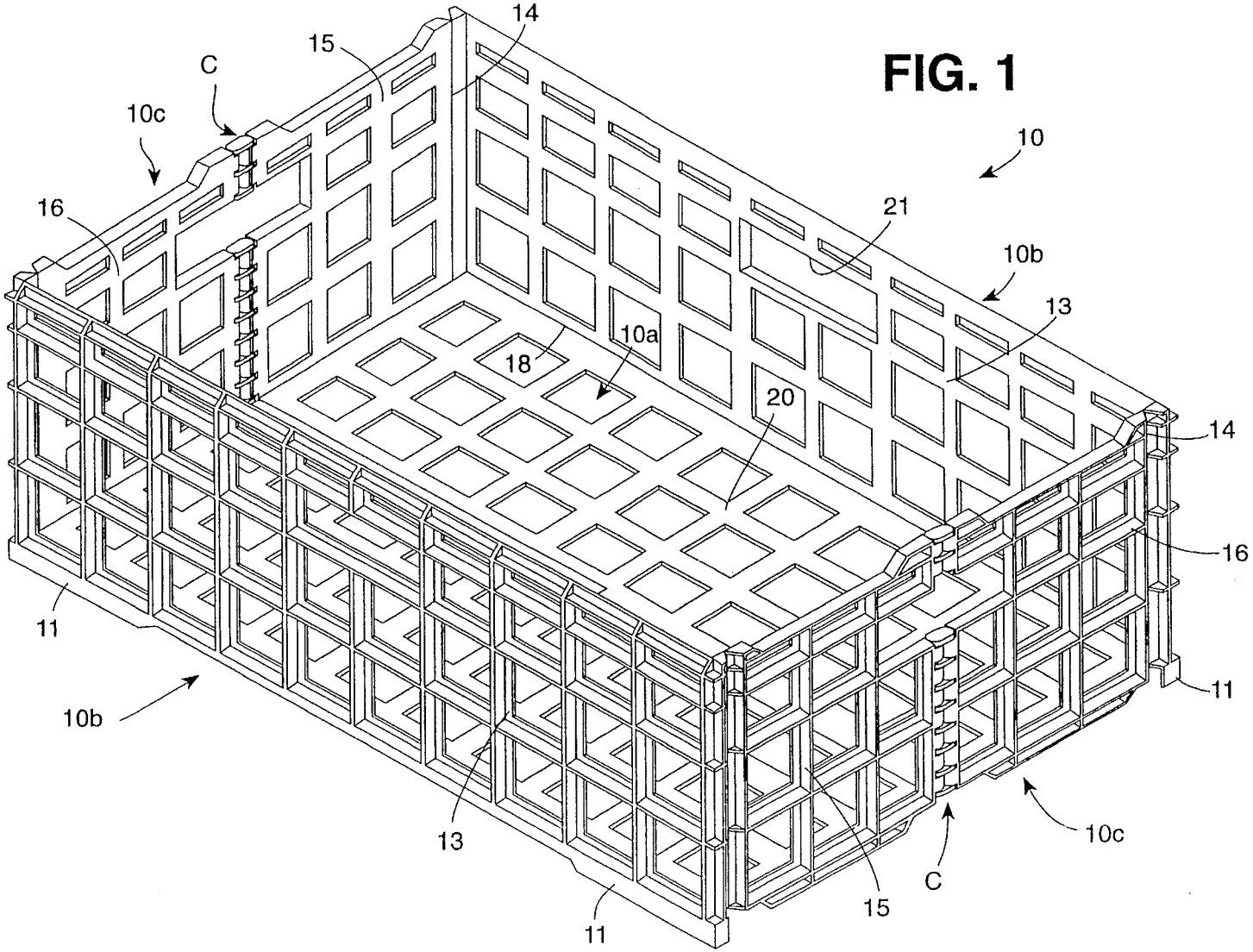
FIG. 1 is a perspective view of a case according to the presente finding, in its open configuration.

Refferring to the drawings, the reference numeral (10) generally indicates a folding case for fruit and vegetables advantageously made of a polyolefinic material (polyethylene, polypropylene, or ethylene-propylene copolymers). In its open configuration illustrated in FIG. 1, the case (10) displays a rectangular bottom wall (10*a*), two mutually facing side walls (10*c*) arranged along the longer sides of the bottom wall (10*a*) and two mutually facing walls (10*c*) arranged along the shorter sides of the bottom wall (10*a*).

Figure 4:
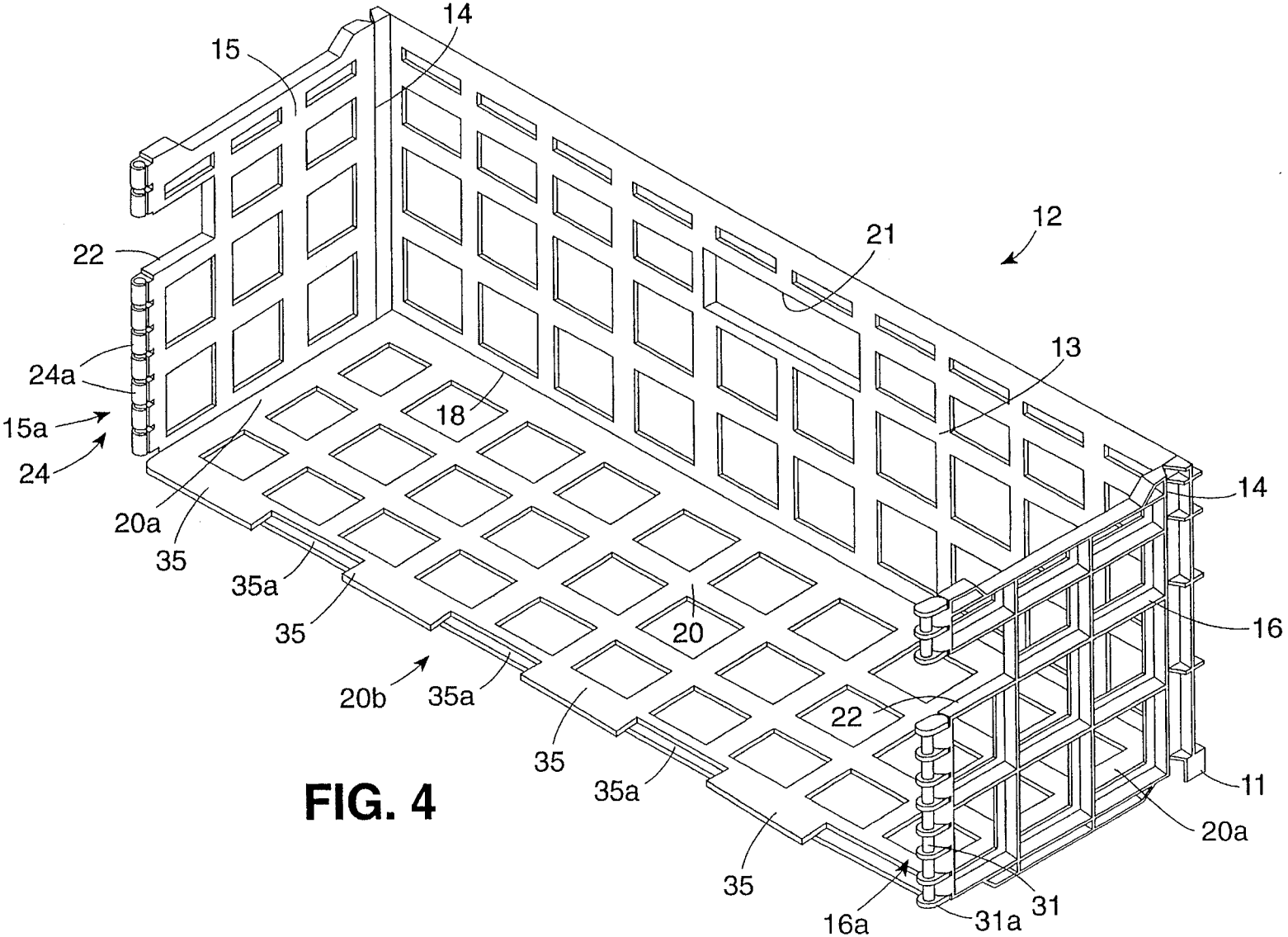
FIGS. 4–5 are similar perspective views to FIG. 3, which illustrate two modifications of the case according to the present finding.
Figure 5:
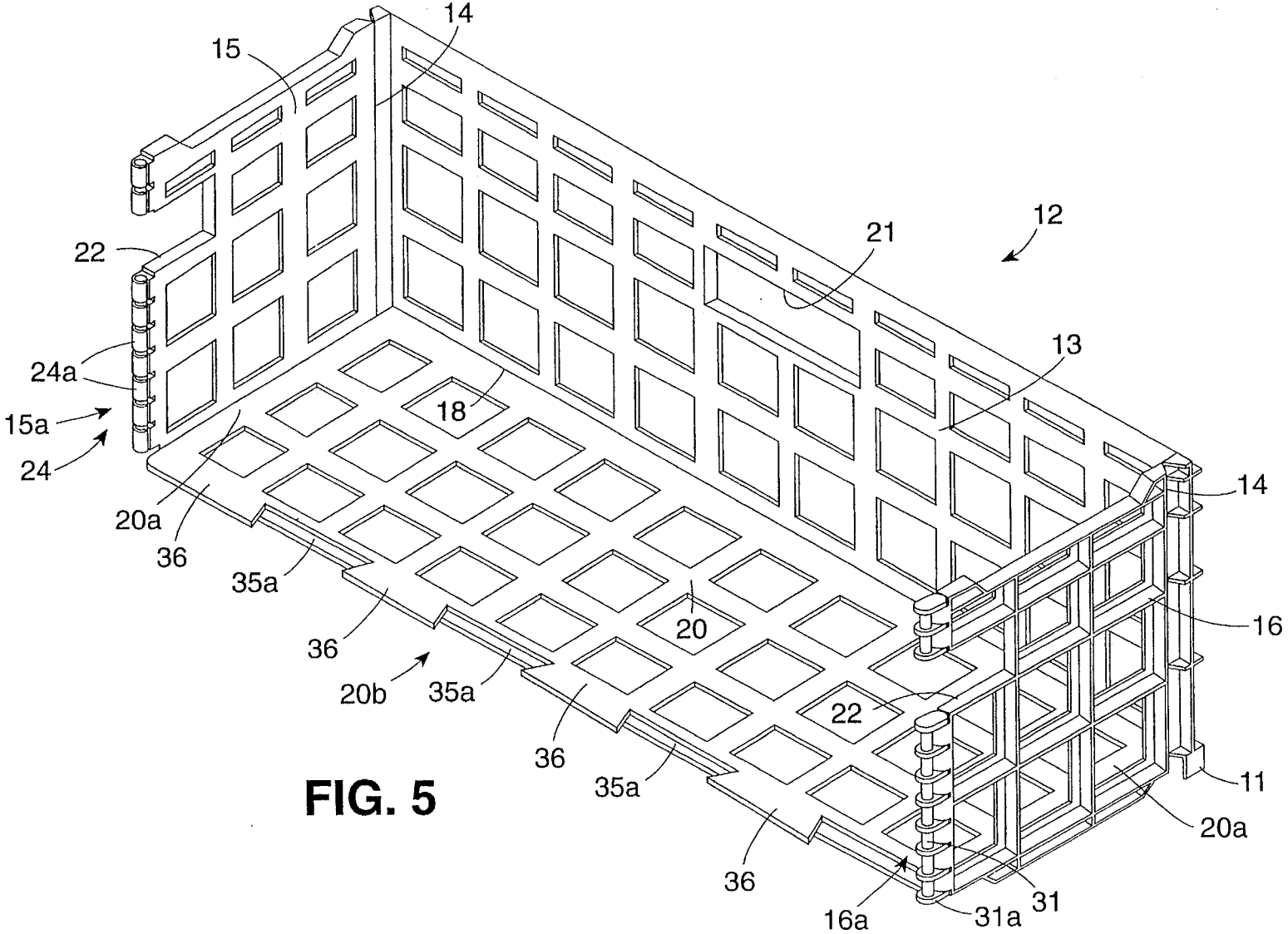

The case (10) is constituted by two identical elements (12) (FIGS. 3–5) assembled with each other. Each element (12), manufactured, e.g., by traditional injection molding, or by total or partial molding by means of the "air mold" technology, displays an elongated rectangular panel (13) suitable for defining one of the side walls (10*b*) of the case, onto which two panels, respectively indicated with 15 and 16, and having a substantially square shape, each of which is suitable for defining a half of the respective end wall (10*c*), are articulatedly linked by means of film hinges (14), obtained by molding. Onto the panel (13), a base panel (20) suitable for defining a half of the bottom wall (10*a*) of the case is furthermore articulatedly linked by means of a third film hinge (18).

Figure 11:
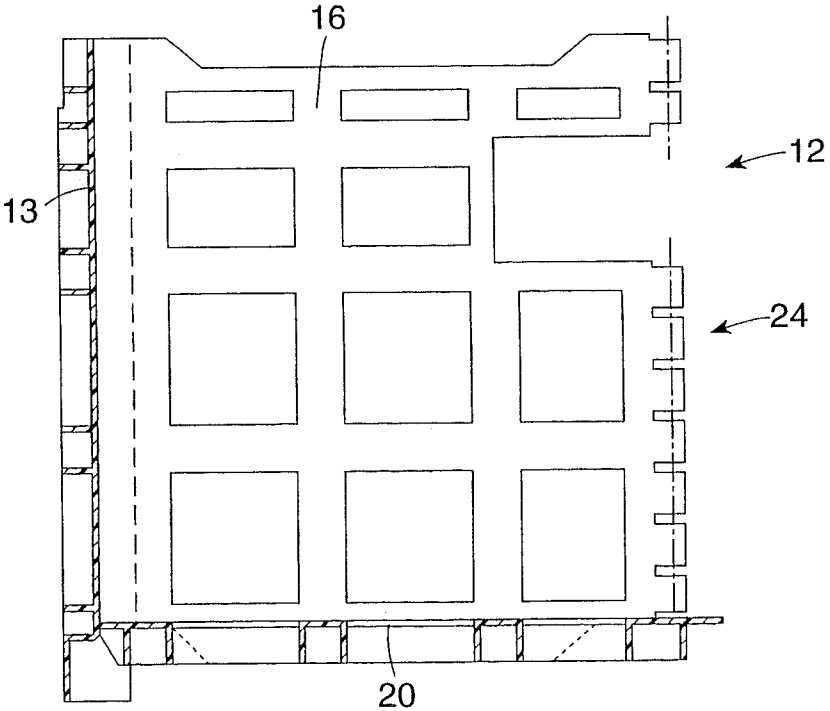
FIGS. 10–12 are cross-sectional views, in open configuration, of the elements which constitute the case, realized according to slightly different modifications.
Figure 10:
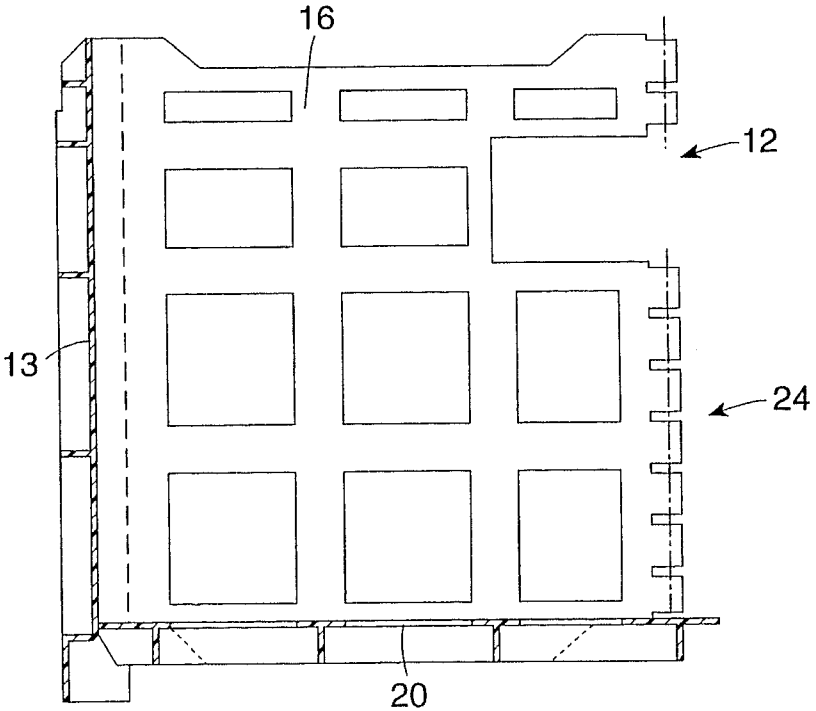
Figure 13:
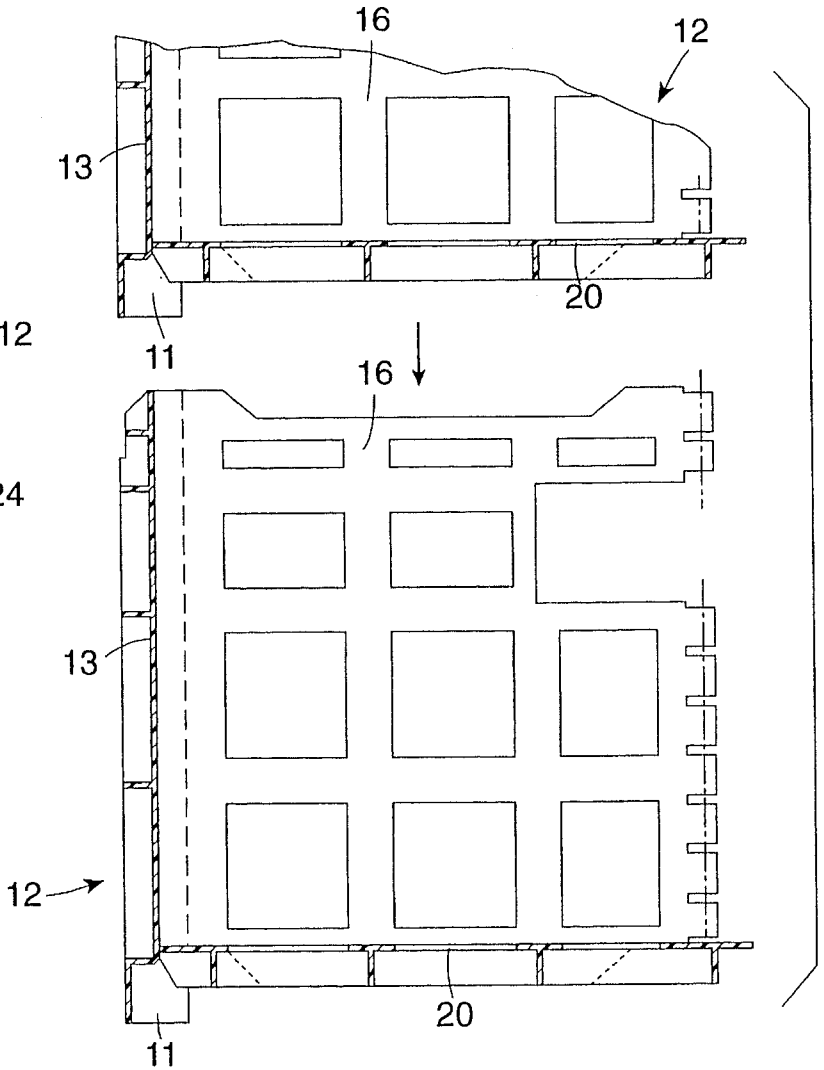
FIG. 13 is a similar view to FIG. 10, and illustrates two case stacking modality.
Figure 12:
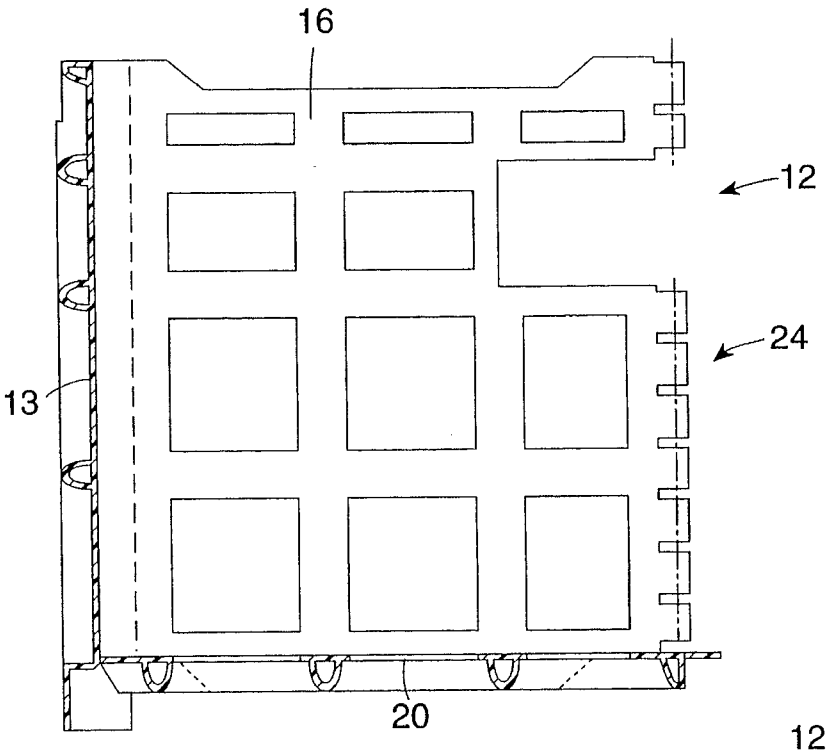

As it is clearly illustrated in the drawings, the panels (13), (15), (16) and (18) which constitute each element (12) are provided with quadrangular lightening holes, and each of them displays a flat structure with "T"-shaped ribs (FIG. 10); furthermore, embodiments with "C"-shaped ribs (FIG. 11) and with hollow circular-cross-section rods realized by the "air mold" technology (FIG. 12) are also envisaged. The side panel (13) displays furthermore a quadrangular, larger-size hole (21), suitable for acting as a handle of the case (10); in an analogous way, the panels (15) and (16) have, at respective edges (15*a*) and (16*a*) opposite to the film hinges (14), rectangular hollows (22) suitable for defining, together with the corresponding notches in the panels (15) and (16) of the complementary element (12), handles for case grasping. The panels (13) are furthermore provided, at their low side, with support feet (11) substantially arranged at the four corners of the case and provided with shoulders for allowing the cases to be stacked, i.e., superimposed, to each other, so as illustrated in FIG. 13. The position of the feet (11) is such as to allow the forks of the lift trucks to be inserted.

Figure 2:
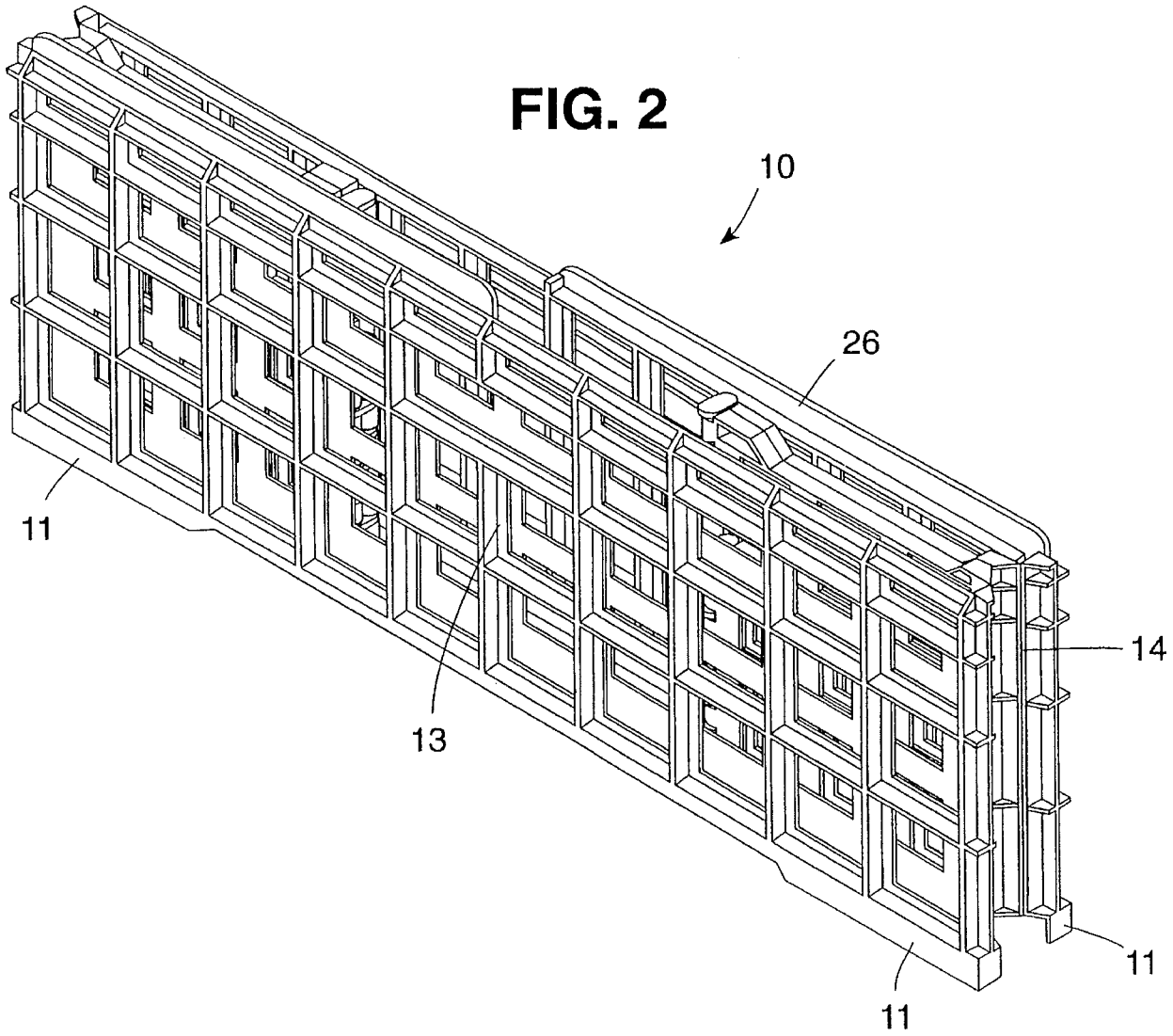
FIG. 2 is a perspective view of the case of FIG. 1 in its closed configuration.
Figure 15:
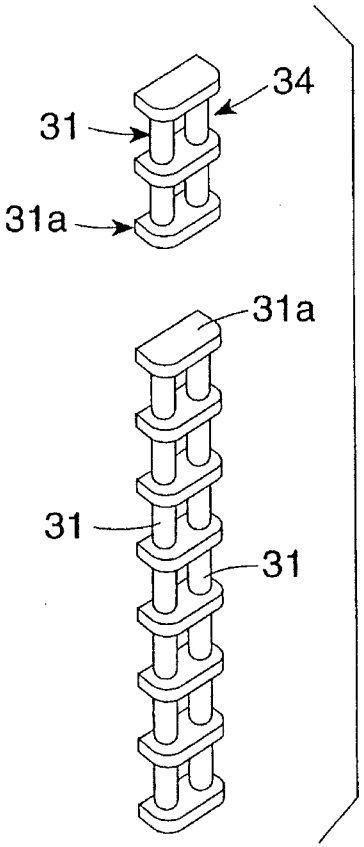
FIG. 15 is a perspective view of the central element of the dismanteable hinge used in the case according to the present finding.

At its respective edge (15*a*), the panel (15) of the element (12) is provided with a pintle (24) of a mechanical hinge, bonded to the panel by glue bonding, or heat welding (either by hot blade, or ultra sounds), or integrally provided with the panel (15), by molding. The pintle (24) is constituted by a plurality of hook-shaped elements (24*a*), which centrally define a seat for a corresponding pivot (31) assembled onto the edge (16*a*) of the panel (16). In the assembled configuration of the case illustrated in FIGS. 1 and 2, the pintles (24) and the corresponding pivots of both elements (12) constitute mechanical hinges, indicated with the reference numeral (C), which allow the walls (10*c*) of the case (10) to only collapse towards the interior of the case. In FIG. 15, the central component of the hinge (C) is displayed, which comprises the coupled pivots (31) united by flat elements (31*a*) having such a configuration as to prevent the end walls (10*c*) to rotate towards the outside of the case.

Figure 3:
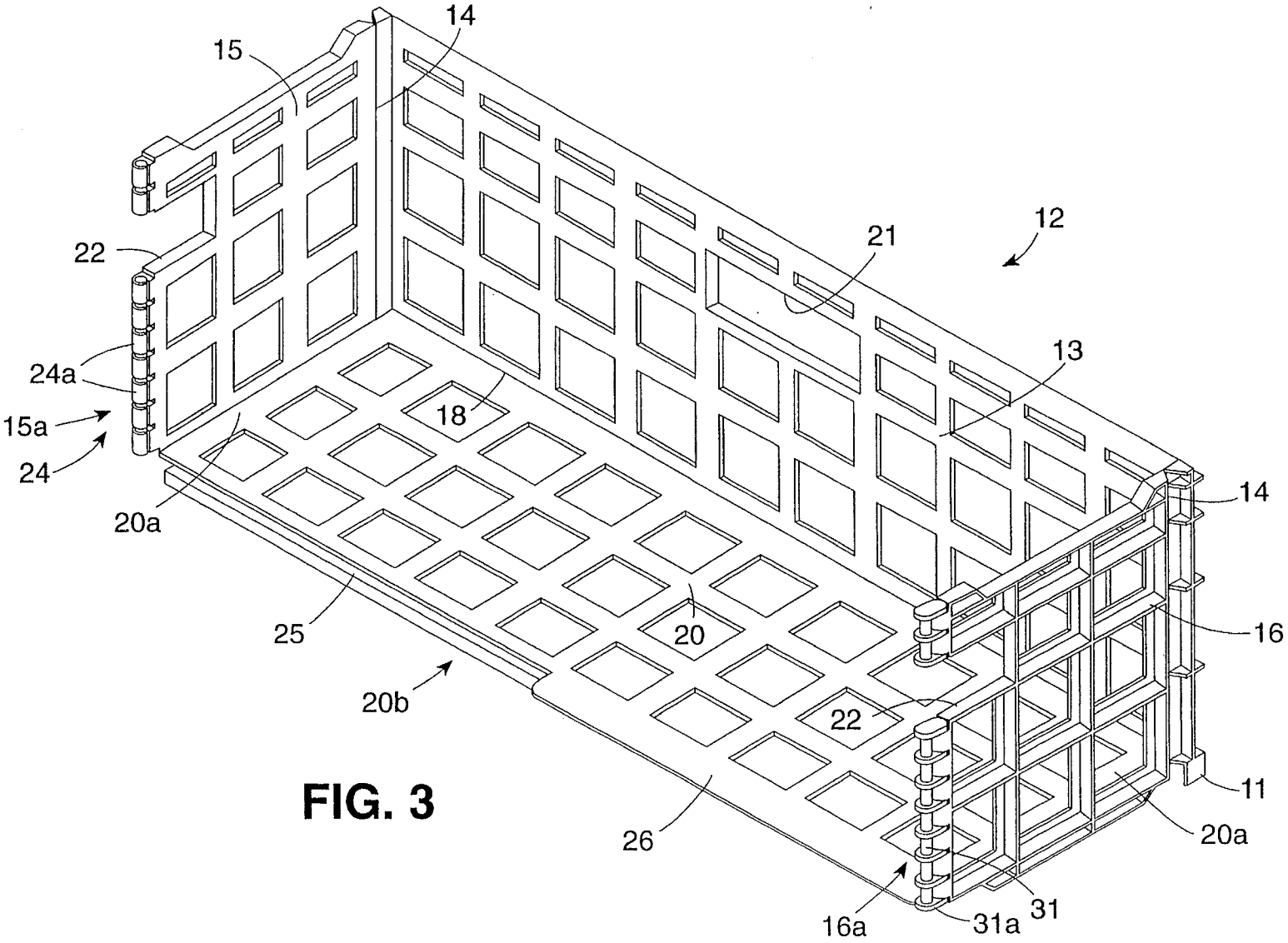
FIG. 3 is a perspective view of the single element from which the case of FIG. 1 is realized.
Figure 6:
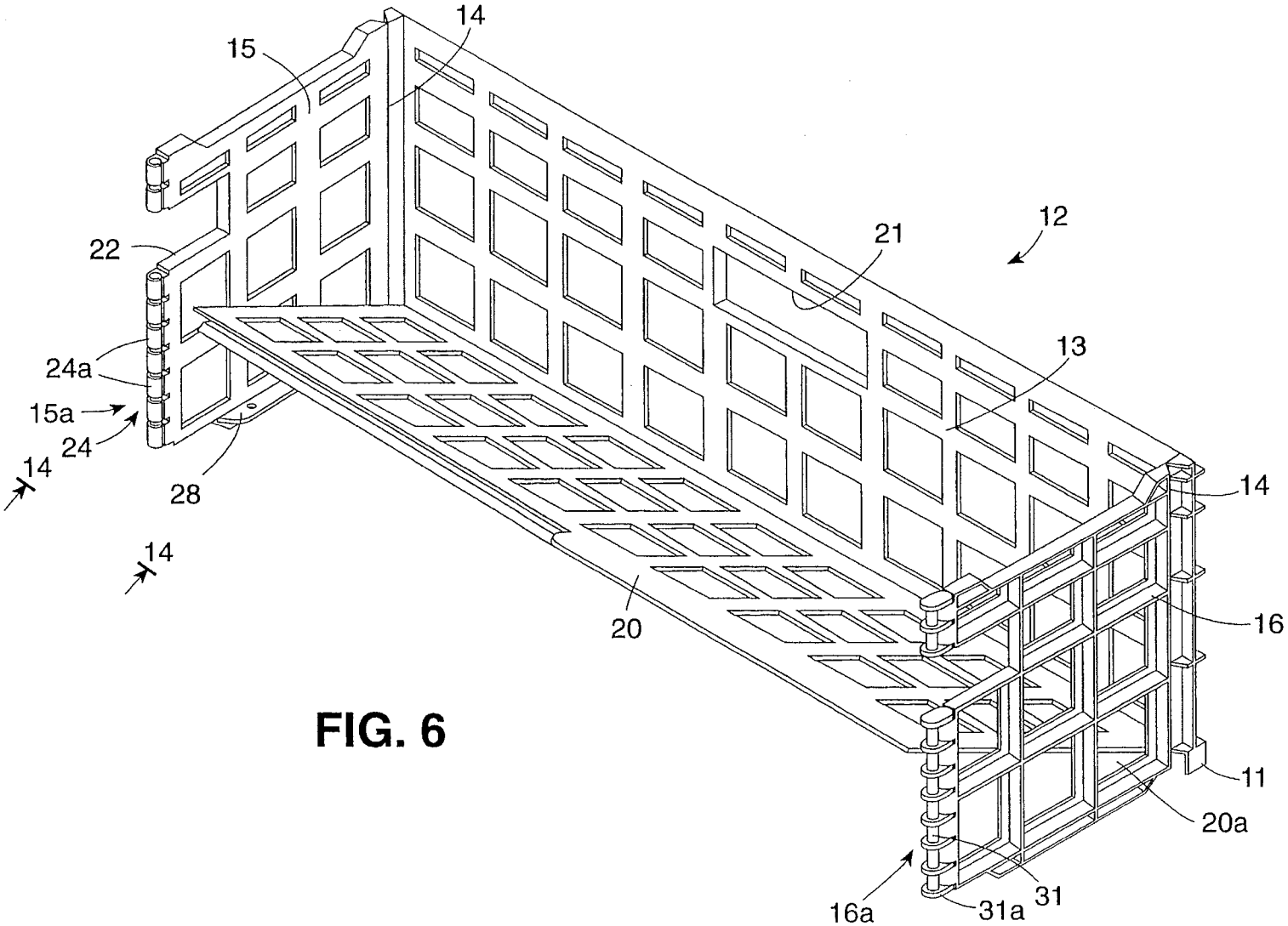
FIGS. 6–9 are perspective views which illustrate the steps of case folding in which, for the sake of clearness, one of the two elements which constitute the case is omitted.
Figure 7:
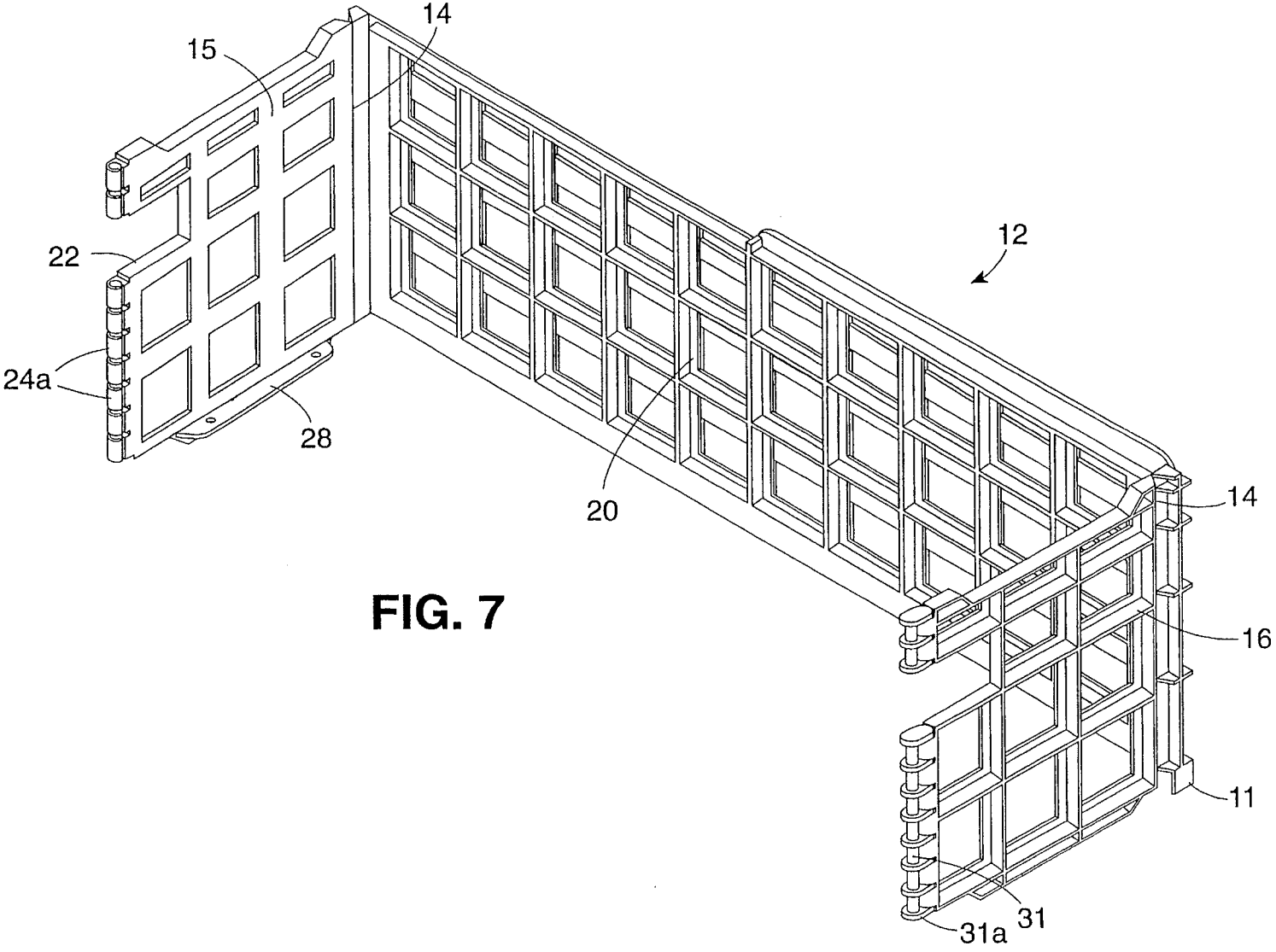
Figure 8:
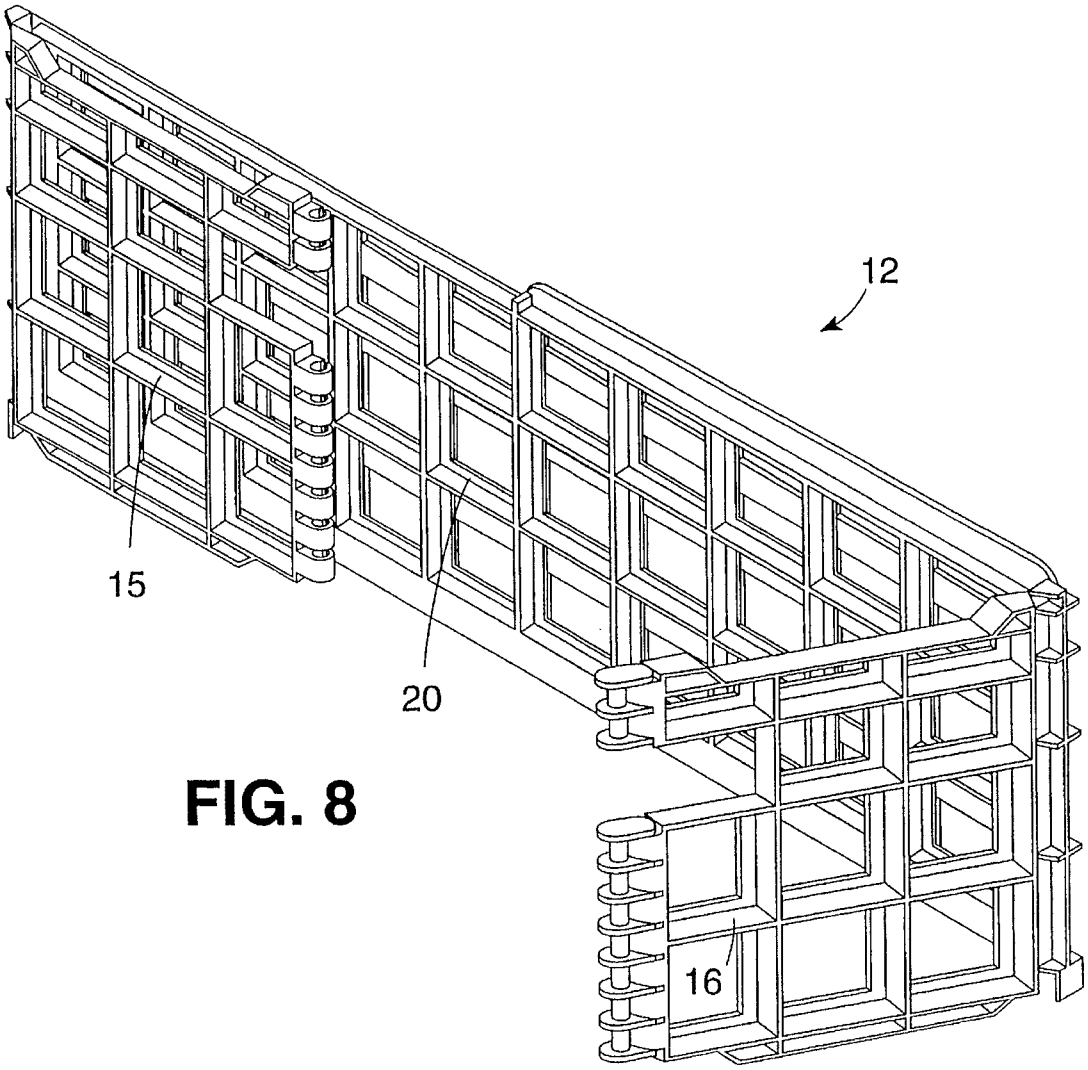
Figure 9:
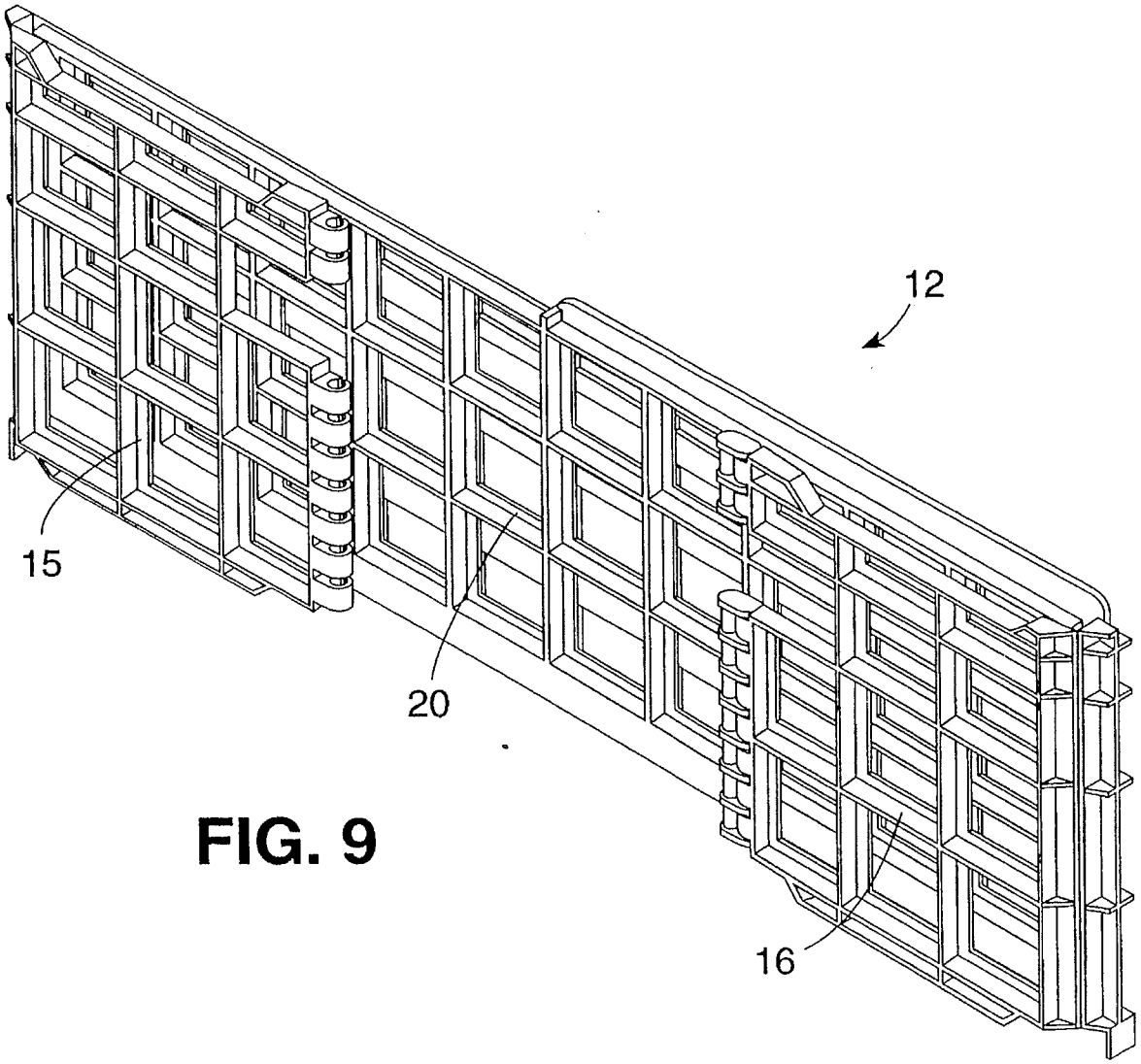
Figure 14:
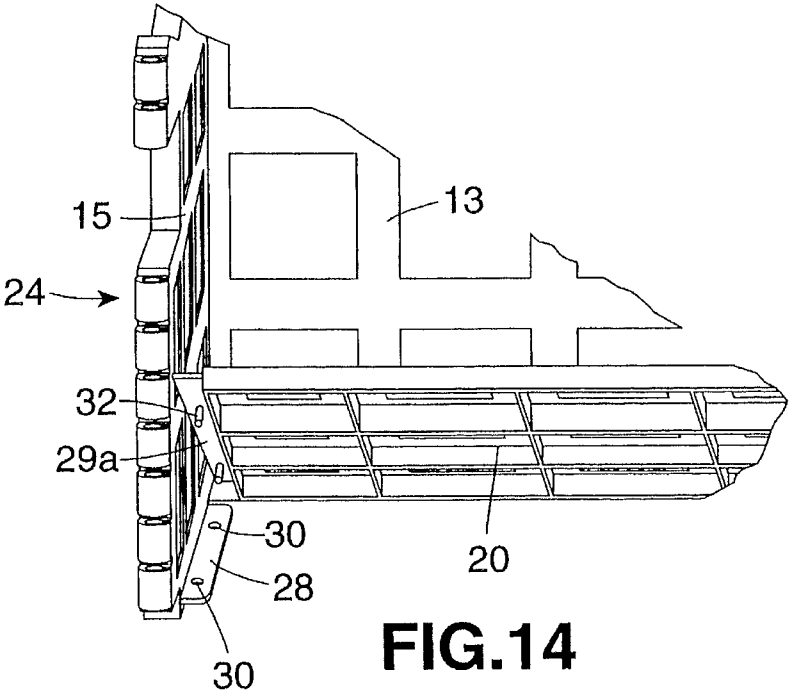
FIG. 14 is a perspective view, on an enlarged scale, of a detail of FIG. 6.

Referring to FIGS. 6 and 7, each panel (15) and (16) is provided with a wing (28) protruding towards the interior of the case and on which in the open configuration of the case a corresponding edge portion (20*a*) of the base panel (20) perpendicular to the film hinge (18), comes to rest. On such a shoulder, as illustrated in FIG. 14, also mechanical locator means are provided which consist of holes (30) on the wing 28, corresponding to coupling pins (32) provided on the lower face of the edge portion (20*a*) of the base panel (20). The resting is also realized at an edge (20*b*) of the base panel (20) opposite to the film hinge (18). According to as illustrated in FIG. 3, the shoulder between the edges (20*b*) is obtained at a recess (25) extending along half of said edge, and a protruding wing (26), also extending along half of said edge, and suitable for cooperating with the recess (25) of the opposite element (12), in order to realize a mechanical locator means for the panels (20) which constitute the bottom (10*a*) of the case. Also a solution is envisaged, according to which rectangular teeth (35) are provided, which rest one on the recess (35*a*) comprised between adjacent teeth (FIG. 4); or, a solution is also envisaged according to which, in an analogous way, dove-tail teeth (36) are provided.

For the first assembly of the case, it is enough that the operator mechanically couples, e.g., by elastic snap coupling, both hinges C of two mutually opposite elements (12); no further operations are necessary, and the case is ready for use.

FIGS. 6–9 illustrate the folding operation of the case (10), from which, for the sake of clearness, one of both elements (12) is removed. In FIG. 6, the beginning is displayed of the folding of the base panel (20), which rotates around the film hinge (18), until it comes to the folded configuration illustrated in FIG. 7. Subsequently, the end walls (10*c*) [i.e., panels (15) and (16) of FIGS. 8 and 9] are folded, with the minimal overall dimensions configuration illustrated in FIG. 2 being obtained.

Of course, the dimensions of the folding case can vary as a function of the use type; however, in order to comply with the European Standard "Europallet", manufacturing a case having, in plan, the size of 600 mm×400 mm, with a height of 200 mm, is preferred.

We claim:

1. A collapsible crate which comprises:

a pair of substantially identical half-crates which cooperate to form the collapsible crate, each of the half-crates comprising:

a) a side wall having opposite ends and a bottom;

b) a pair of end walls each having first and second opposed edges;

c) a hinge for rotatably attaching the first edge of each of the end walls to an opposite end of the side wall between an open position in which each wall is substantially perpendicular to the side wall, and a collapsed position in which the end walls are rotated toward each other and against the side wall;

d) a bottom wall having first and second opposed edges; and e) a hinge for rotatably attaching one edge of the bottom wall to the bottom of the side wall between an open position in which the bottom wall is substantially perpendicular to the side wall, and a collapsed position in which the wall is rotated against the side wall;

f) means for rotatably attaching the second edge of each side wall to an associated sidewall second edge of the other half-crate; and g) means for releasably attaching the second edge of the bottom wall to the second edge of the bottom wall of the other half-crate.

2. A collapsible crate according to claim 1 wherein each side wall comprises a support for supporting the bottom wall with the crate in the open position, the support located toward the bottom of each side wall.

3. A collapsible crate .according to claim 2 wherein the means for rotatably attaching comprises snap couple means.

4. A collapsible crate according to claim 1 wherein the hinge for rotatably attaching the first edge of each of the end walls to an opposite end of the side wall or the hinge for rotatably attaching one edge of the bottom wall to the bottom of the side wall comprises a film hinge.

5. A collapsible crate .according to claim 1 wherein the means for rotatably attaching comprises an articulation hinge.

* * * * *